United States Patent [19]

Tokuno

[11] 4,096,941

[45] Jun. 27, 1978

[54] CONVEYOR SYSTEM FOR A CUTTER FOR A WEB OF CORRUGATED FIBERBOARD

[75] Inventor: Masateru Tokuno, Nishinomiya, Japan

[73] Assignee: Rengo Kabushiki Kaisha, Osaka, Japan

[21] Appl. No.: 745,926

[22] Filed: Nov. 29, 1976

[30] Foreign Application Priority Data

May 28, 1976 Japan ..... 51-69078[U]

[51] Int. Cl.[2] ..... B65G 47/91

[52] U.S. Cl. ..... 198/689; 271/197

[58] Field of Search ..... 198/689, 817; 271/96, 271/108, 196, 197

[56] References Cited

U.S. PATENT DOCUMENTS

| | | | |
|---|---|---|---|
| 2,339,268 | 1/1944 | Huffman | 271/195 |
| 3,198,517 | 8/1965 | Martin | 271/197 |
| 3,476,241 | 11/1969 | Ungerer | 271/197 X |
| 3,500,999 | 3/1970 | Lippke | 271/197 X |
| 3,592,329 | 7/1971 | Fleischauer | 198/689 X |
| 3,617,048 | 11/1971 | Albert | 271/108 |
| 3,659,840 | 5/1972 | Ruck | 271/197 X |

*Primary Examiner*—Evon C. Blunk
*Assistant Examiner*—James L. Rowland
*Attorney, Agent, or Firm*—Wenderoth, Lind & Ponack

[57] ABSTRACT

A conveyor system for feeding a web of corrugated fiberboard into or out of a cutter. It includes perforated conveyor belts mounted on a suction box which is formed with longitudinal slits in its top surface. The web is securely transferred with a sufficient, but not excessive, holding force without slipping or crushing of corrugations in the fiberboard.

3 Claims, 4 Drawing Figures

CONVEYOR SYSTEM FOR A CUTTER FOR A WEB OF CORRUGATED FIBERBOARD

The present invention relates to a conveyor system for feeding a web of corrugated fiberboard into or out of a cutter.

BACKGROUND AND SUMMARY OF THE INVENTION

To cut a corrugated fiberboard web into regular lengths, a pair of feed rolls has been heretofore used to feed it into and out of the cutter. But, if the holding or nip force applied by the feed rolls were insufficient, there would occur some slipping of web which necessarily results in dimensional error. On the other hand, excessive holding force would deform or crush the corrugated midium layer of the fiberboard. This means a considerable drop in the compressive strength of these.

An object of the present invention is to provide a conveyor system which can feed a corrugated fiberboard web into or out of a cutter without causing undue slippage, deformation or crushing of any of the corrugations in the web.

According to the present invention, there is provided a conveyor system which comprises a plurality of perforated conveyor belts mounted on a suction box which communicates with a vacuum source and is provided with a plurality of longitudinal slits disposed to be in alignment with the perforations in the conveyor belts.

Other objects and advantages of the present invention will become apparent from the following description taken in connection with the accompanying drawings, wherein.

DETAILED DESCRIPTION OF THE INVENTION

Figure 1:
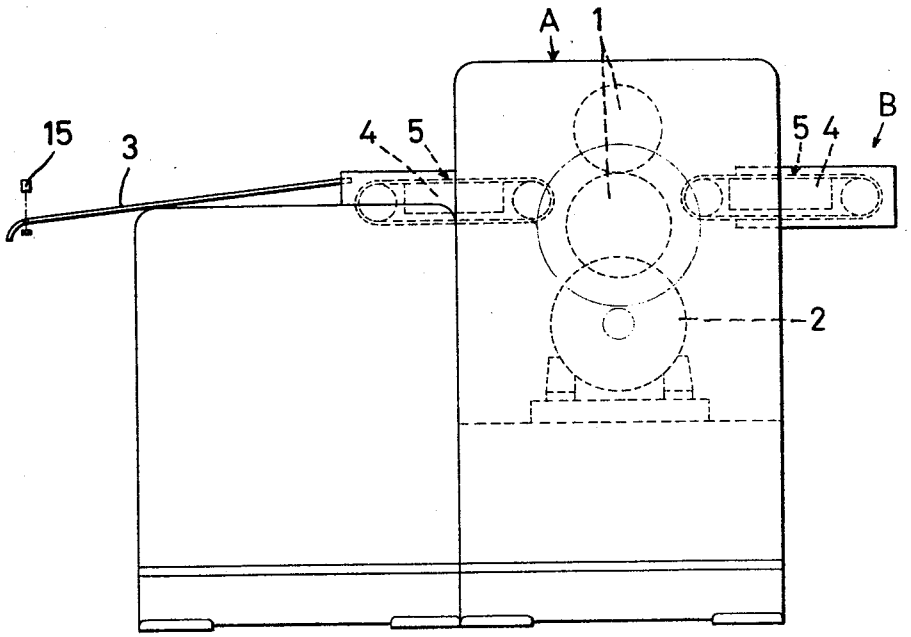
FIG. 1 is a side view of the fiberboard web cutter provided with the conveyor system according to this invention.
Figure 2:
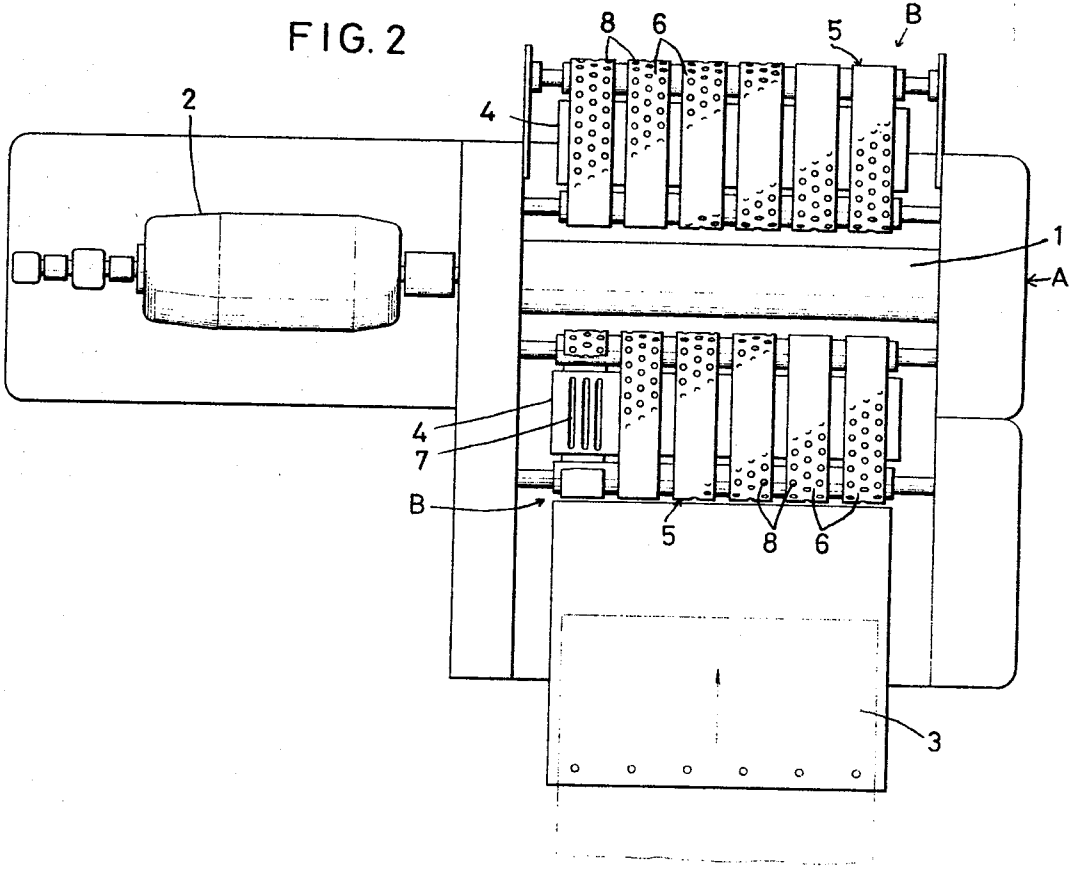
FIG. 2 is a partially cut-away plan view of the cutter shown in FIG. 1.
Figure 3:
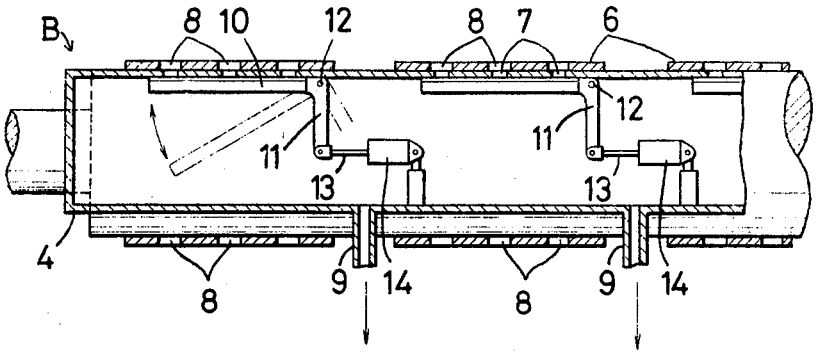
FIG. 3 is a vertical sectional front view of a portion of the conveyor system.

Referring to the drawings, the letter A generally designates a cutter including a pair of rotating bodies 1 which are driven by a motor 2 and have a cutting blade mounted on the periphery thereof to cut a web of corrugated fiberboard 3 fed therebetween.

The letter B generally designates a conveyor system provided in front of and behind the cutter A to feed the fiberboard web 3 into and out of the cutter, respectively. The conveyor system may, however, be provided only in front of the cutter. The conveyor system includes a suction box 4 and a belt conveyor 5 having a plurality of perforated conveyor belts 6 mounted on the suction box 4 in parallel with each other and with a suitable spacing therebetween. The fiberboard web 3 is carried on the advancing side of the belts 6.

The suction box 4 is provided in its top with a plurality of longitudinal slits 7 so as to be in alignment with the perforations 8 formed in the belts 6. The suction box 4 is also provided through its bottom with a plurality of suction ports 9 which communicate with a vacuum source.

A plurality of valve plates 10 are provided in the suction box 4 to close the slits 7 from underneath. Each valve plate 10 is pivotally connected at one end to a lever 11 and is pivotable about a pivot 12, said lever being coupled to a piston rod 13 of a cylinder 14 mounted in the suction box 4.

For each conveyor belt 6, one detector 15 having a light source and a phototube is provided upstream of the conveyor system B. When the light from each detector 15 is interrupted by the fiberboard web 3 being fed toward the cutter, the respective cylinder 14 operates to pull the piston rod 13 to pivot the valve plate 10 counterclockwise to open the slits 7 for which the valve plate 10 serves. The latter normally closes the slits 7.

Thus, the fiberboard web 3 is carried on the belts 6 while being attracted to the surface thereof by vacuum acting thereon through the slits 7 in the suction box 4 and the perforations 8 in the belts 6. It is fed between the rotating bodies 1 and is cut into predetermined lengths. The cut pieces of fiberboard are pulled out of the cutter by means of another conveyor system B provided on the other side of the rotating bodies.

If the fiberboard web to be cut is narrower than the belt conveyor 5 so that some of the belt 6 are not covered by the web, the light from the detector 15 in the corresponding position will not be interrupted by the web so that the cylinder 14 is not actuated, thus leaving the slits 7 closed by the valve plate 10.

This arrangement ensures that the inflow of outside air through the slits 7 not covered by the fiberboard web is avoided so that the suction force effectively acts on the web, thus minimizing power requirement.

Figure 4:
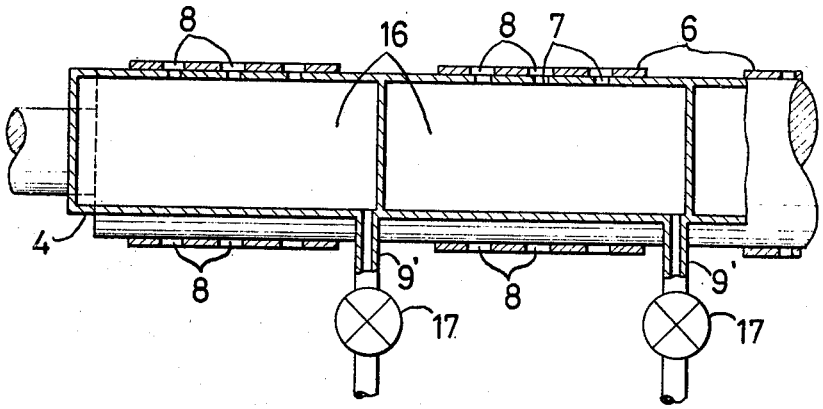
FIG. 4 is a view similar to FIG. 3 in another embodiment.

FIG. 4 shows the second embodiment in which the suction box 4 is separated into as many compartments 16 as the conveyor belts 6, each compartment being provided with a suction portion 9' communicating with a vacuum source through a valve 17 which is provided instead of the valve plate 10 and actuated by the respective detector 15.

In this embodiment, if the web is wide enough to cover all the conveyor belts, the detectors 15 actuate all the valves 17 to open so that all the compartments 16 will communicate with a vacuum source. If it is narrower than the belt conveyor 5, some of the detectors 15 will not operate since the light therefrom is not interrupted, thus leaving the corresponding valves 17 closed.

In order to compare the corrugated fiberboard transported by the conveyor system of the present invention with the one done by the conventional feed rolls, we have measured their flat compressive strength in accordance with the testing method set forth in the Japanese Industrial Specifications (JIS).

Four kinds of corrugated fiberboards of different weight, thickness and the number of corrugations per unit length were used as samples. Each sample of a suitable size was put in the center of a compression plate and subjected to a compressive load applied from a direction normal thereto until its corrugations were completely crushed. The flat compressive strength of a corrugated fiberboard is defined as the maximum force carried by it before such a complete crushing occurs. The results of testing are as indicated below. The flat compressive strength is given in $kg/cm^2$.

| Sample No. | | Fiberboard processed by conventional feed rolls (in kg/cm²) | Fiberboard processed by this conveyor system (in kg/cm²) | Increment (in %) |
|---|---|---|---|---|
| | Max. | 1.60 | 1.66 | |
| 1 | Min. | 1.49 | 1.59 | |
| | Mean | 1.55 | 1.64 | 5.8 |
| | Max. | 2.51 | 2.64 | |
| 2 | Min. | 2.40 | 2.60 | |
| | Mean | 2.48 | 2.61 | 5.2 |
| | Max. | 2.08 | 2.17 | |
| 3 | Min. | 1.97 | 2.07 | |
| | Mean | 2.02 | 2.13 | 5.4 |
| | Max. | 2.81 | 2.96 | |
| 4 | Min. | 2.74 | 2.90 | |
| | Mean | 2.79 | 2.93 | 5.0 |

The testing shows that the corrugated fiberboard carried by the conveyor system according to this invention has a larger flat compressive strength than the one done by the conventional method.

It will be understood from the foregoing that the conveyor system according to the present invention can feed the fiberboard web securely into or out of the cutter with a sufficient holding force by vacuum action. This ensures that there will be no dimensional error during cutting and no drop in the compressive strength of the fiberboard.

The conveyor system according to the present invention may be applied to double wall and triple wall corrugated fiberboards as well as a single wall one. The "wall" in these terms refer to a corrugated layer.

Many variations or changes will occur to a person skilled in the art within the scope of the present invention.

What is claimed is:

1. A conveyor system for feeding a web of corrugated fiberboard into and out of a cutter, said conveyor system comprising:

belt conveying means at the entrance into and exit from said cutter for carrying said fiberboard into and from said cutter, said conveying means comprised of:

a plurality of parallel, longitudinal perforated conveyor belts arranged side by side leading into and from said cutter;

suction box means beneath said plurality of perforated conveyor belts and having a plurality of openings in the top thereof aligned with said perforations in said conveyor belts for attracting said conveyor belts and said fiberboard thereon;

vacuum source means connected to said suction box means for creating a vacuum in said suction box means;

suction control means within said suction box means for controlling the suction through said openings in said suction box means beneath said conveyor belts; and detecting means at the forward end of said belt conveying means and connected to said suction control means for detecting the width of the fiberboard on said conveyor belts and for regulating said suction control means in said suction box means corresponding to the width of fiberboard being carried by said conveyor belts, whereby the effective width of said belt conveying means is adjusted by providing vacuum from said suction box means only beneath those conveyor belts carrying fiberboard, said detecting means being comprised of a light source and a phototube on opposite sides of each of said parallel, longitudinal perforated conveyor belts.

2. A conveyor system as claimed in claim 1, wherein:

said suction box means is comprised of a plurality of longitudinal suction compartments with openings in the tops thereof, at least one of said compartments being longitudinally aligned with each of said perforated conveyor belts;

said suction control means is comprised of a plurality of valve members, one valve member between said vacuum source means and each of said suction compartments, each valve member being connected to said detecting means; and said detecting means controls the openings and closing of said valve members and thus provides vacuum to only those suction compartments beneath said conveyor belts carrying said fiberboard thereon as detected by said detecting means.

3. A conveyor system as claimed in claim 1, wherein:

said suction box means is comprised of a longitudinal compartment connected to said vacuum source means and has a plurality of openings in the top thereof longitudinally aligned with and separately corresponding to each of said conveyor belts;

said suction control means is comprised of a plurality of plate means pivotally mounted beneath said aligned longitudinal openings beneath said conveyor belts for opening and closing said openings beneath each corresponding belt; and said detecting means is connected to said plate means and controls the movement of said plate means away from said openings corresponding to said belt conveyors thereabove with said fiberboard thereon, whereby only those openings are open which correspond to the width of fiberboard on said conveyors detected by said detecting means.

* * * * *